US005497166A

United States Patent [19]

Mahnad

[11] Patent Number: 5,497,166

[45] Date of Patent: Mar. 5, 1996

[54] DUAL FREQUENCY BATWING ANTENNA

[76] Inventor: Ali R. Mahnad, 5063 Olive Oak Way, Carmichael, Calif. 95608

[21] Appl. No.: 337,129

[22] Filed: Nov. 10, 1994

Related U.S. Application Data

[63] Continuation of Ser. No. 84,293, Jun. 28, 1993, abandoned.

[51] Int. Cl.[6] ..... H01Q 21/20

[52] U.S. Cl. ..... 343/795; 343/799; 343/890

[58] Field of Search ..... 343/795, 797, 343/798, 799, 800, 810, 890, 891, 893, 742, 812, 813, 814, 867, 807, 725, 727, 729, 730; H01Q 21/20, 21/28, 21/30

[56] References Cited

U.S. PATENT DOCUMENTS 3,747,111 7/1973 Fletcher et al. ..... 343/725

4,180,420 12/1979 Johns ..... 343/798

OTHER PUBLICATIONS

Broadcast Engineering Aug. 1992 article entitled "HDTV: Antennas for Terrestial Services". pp. 38–46.

*Primary Examiner*—Michael C. Wimer

*Attorney, Agent, or Firm*—Flehr, Hohbach, Test, Albritton & Herbert

[57] ABSTRACT

A dual frequency batwing antenna includes a larger batwing with smaller UHF batwings located in substantially the same plane but within a vacant space provided by the larger batwing. The smaller batwings are also co-linear so there is no inductive coupling. Thus a pair of radio frequency signals are radiated from a common aperture.

4 Claims, 4 Drawing Sheets

DUAL FREQUENCY BATWING ANTENNA

This is a continuation of application Ser. No. 08/084,293 filed Jun. 28, 1993, abandoned.

The present invention is directed to a dual frequency batwing type antenna and more specifically to an antenna especially useful for high definition television (HDTV).

BACKGROUND OF INVENTION

Implementation of high definition television (HDTV) in the U.S. is now undergoing testing by the Federal Communications Commission. It is contemplated that such an HDTV system will require additional channel allocations on UHF frequencies which will carry a digital signal. Thus alterations to existing transmitting antennas will be required. The existing TV signal is normally designated an NTSC signal which is analog. It is contemplated that the HDTV digital signal will be located on the same transmission tower. However, because of the normal NTSC signal is in the VHF frequency range, such VHF antenna cannot simultaneously serve UHF channels. In such cases, the HDTV operation will require a separate antenna in a different location of the tower.

Since the physical location of an antenna on a transmitting tower used by several TV stations is quite critical, to locate the HDTV antenna on another part of the tower, or even relocate the entire antenna installation is not desirable.

OBJECT AND SUMMARY OF INVENTION

It is a general object of the present invention to provide an improved dual frequency antenna especially suited for HDTV.

In accordance with the above object there is provided a radio frequency antenna for radiating a pair of radio frequency signals having first and second frequencies with a ratio of substantially two to one or greater comprising a first pair of radiating elements having a radiation pattern with nulls and being resonant at the first frequency. Two or more pairs of radiating elements resonant at the second frequency are mounted in the nulls of each of the first pair of radiating elements and arranged on a support mast to minimize coupling to the first pair of radiating elements whereby the pair of radio frequency signals are radiated from a common antenna aperture.

DESCRIPTION OF PREFERRED EMBODIMENT

Figure 1:
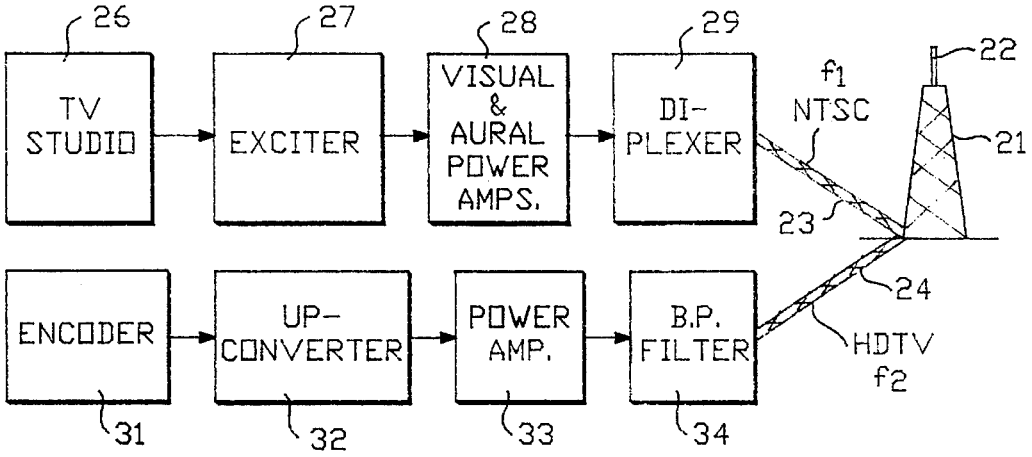
FIG. 1 is a block diagram of a generalized transmitter system as it would drive the antenna of the present invention.

FIG. 1 illustrates a proposed HDTV system where the transmission tower 21, with its antenna on a vertical support mast 22, will radiate or transmit both an NTSC signal received on the coaxial cable 23 and coupled to the tower and a HDTV signal on the coaxial cable or waveguide 24. In general the NTSC signal can be either in the low VHF or high VHF range which are 54–88 MHz and 170–230 MHz, respectively. Also such a signal may be in the UHF band which is 470–800 MHz. In general it is contemplated that the extra HDTV channels will be the UHF channels which were used for spacing.

The remainder of FIG. 1 are standard transmitting system blocks. From a television studio 26, one feed extends to an NTSC channel including an exciter 27, visual and aural power amplifiers 28 and a combining diplexer 29 which feeds the coaxial waveguide 23 and connects to the antenna 21, 22. The second channel from the TV studio 26 includes the encoder 31 to convert the information to digital, an upconverter 32, power amplifier 33, and a band pass filter 34 connecting to the HDTV coaxial 24. The HDTV signal as well as being digital is contemplated to be of the spread spectrum type.

Figure 2:
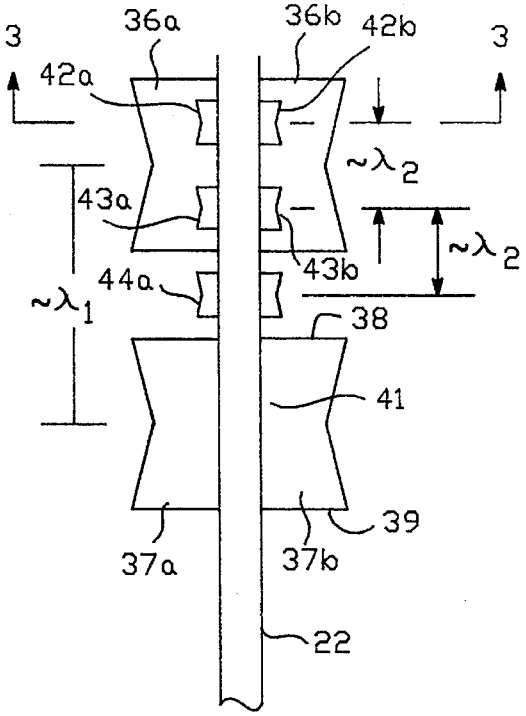
FIG. 2 is a simplified elevational view of the antenna of the present invention.

FIG. 2 illustrates the support mast 22 in greater detail with the actual radiating elements mounted on the vertical support mast. This includes a first pair of batwing radiating elements 36*a*, 36*b*, and a second pair located a wavelength apart 37*a*, 37*b*. These batwings form effective conductive sheets and as will be described later may be constructed of sheet metal or rods. They are resonant and radiate at a first lower frequency $f_1$. This is typically the NTSC signal on the coaxial antenna feed 23 (FIG. 1). Each batwing antenna includes a top, in this case horizontal termination 38, and a bottom termination 39 which circumscribes as will be discussed in more structural detail below the conductive sheet and also a structurally vacant rectangular space 41. This space which is, of course, coplanar with the remainder of the batwing antenna is utilized by the smaller high frequency batwing radiating elements 42*a*, 43*a* and 42*b*, 43*b*. Since the smaller elements must fit within the same common radiating aperture on the antenna mast 22 as the lower frequency batwing elements, it is convenient that the higher frequency, $f_2$, (in this case the HDTV signal) be an integral multiple of the lower frequency. The antenna elements 42*a* and 43*a* are separated also by substantially a wavelength at the second higher frequency as indicated. In addition there is in between, for example, the larger low frequency batwing elements 36*a* and 37*a*, an additional high frequency element 44*a*, etc. This would be also spaced by the wavelength of the second higher frequency as indicated.

Thus the ideal situation is where the higher HDTV frequency is an integral multiple such as 2, 3, or 4 times the NTSC signal. However it is not necessary because at non-integral multiples, the spacing is adjusted to the best fit. And well known techniques of non-uniformly spaced arrays are used to shape the radiation pattern at $f_2$ frequency. This provides for optimum spacing within the same antenna aperture on the same transmitter tower. Typically in a batwing type installation there may be a vertical array of perhaps 3 to 4 batwing elements. And within the vacant rectangular space provided by the low frequency batwings, there may be multiples of 2, 3 or 4 UHF antennas 42*a*, 43*a*, etc.

In order to provide two different operating frequencies within the same antenna aperture, both physical blockage and electrical interference must be minimized. This is accomplished by the present invention as illustrated in FIGS. 3 and 4A and 4B.

Figure 3:
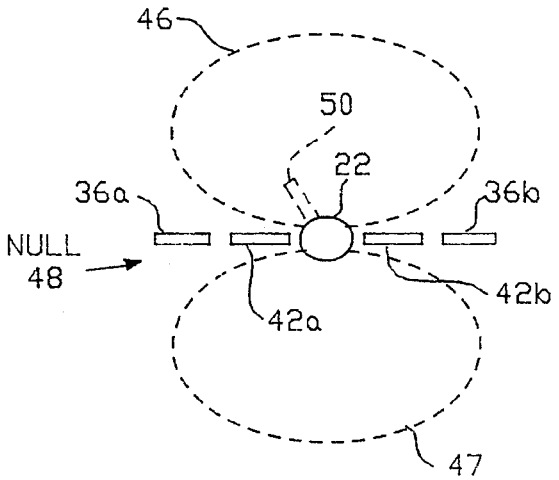
FIG. 3 is a simplified cross-sectional view taken along the line 3—3 of FIG. 2 showing the radiation pattern of a portion of the antenna of the present invention.
Figure 4A:
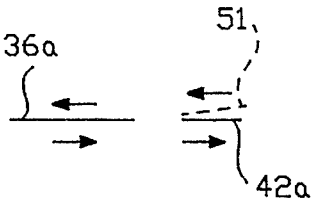
FIGS. 4A and 4B are diagrams illustrating the operation of the present invention.

First referring to FIG. 3, the radiation pattern of the batwing antennas 36*a* and 36*b* are illustrated as ellipses 46 and 47. The mast of course is indicated at 22. An electromagnetic null is effectively provided between the two radiation patterns 46 and 47 as indicated at 48. Within this null are placed batwings 42*a* and 42*b* as indicated without causing any interference. A location such as the dashed batwing 50 would in effect provide a corner reflector.

Besides avoiding interference with the radiation characteristic, the two antennas of high frequency and low frequency must not electrically couple. The ideal arrangement is for the antennas to be co-linear as illustrated in both FIGS. 3 and 4A. Here for the larger batwing antenna 36*a*, the current flows over the surface of the effective conductor sheet in opposite directions. And the same is true of the higher frequency batwing 42*a*. With these currents being colinear, the radiation intensity in the plane of the wings goes to zero. As a result the two elements do not radiate toward each other. And as indicated by the dashed line 51, even if the element 42*a* is slightly angled, there will still not be a significant cross coupling.

Figure 4B:
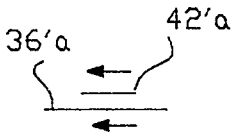

FIG. 4B illustrates both antenna units, designated 36'*a* and 42'*a* adjacent each other and not co-linear. Here there is a significant amount of unwanted coupling because both elements radiate strongly toward each other. Thus in summary by mounting the smaller radiating elements within the null of at least the first pair of lower frequency radiating elements and also arranging them in a noncoupling mode as illustrated in FIG. 4A, a pair of radio frequency signals may be radiated from a common aperture.

Figure 5:
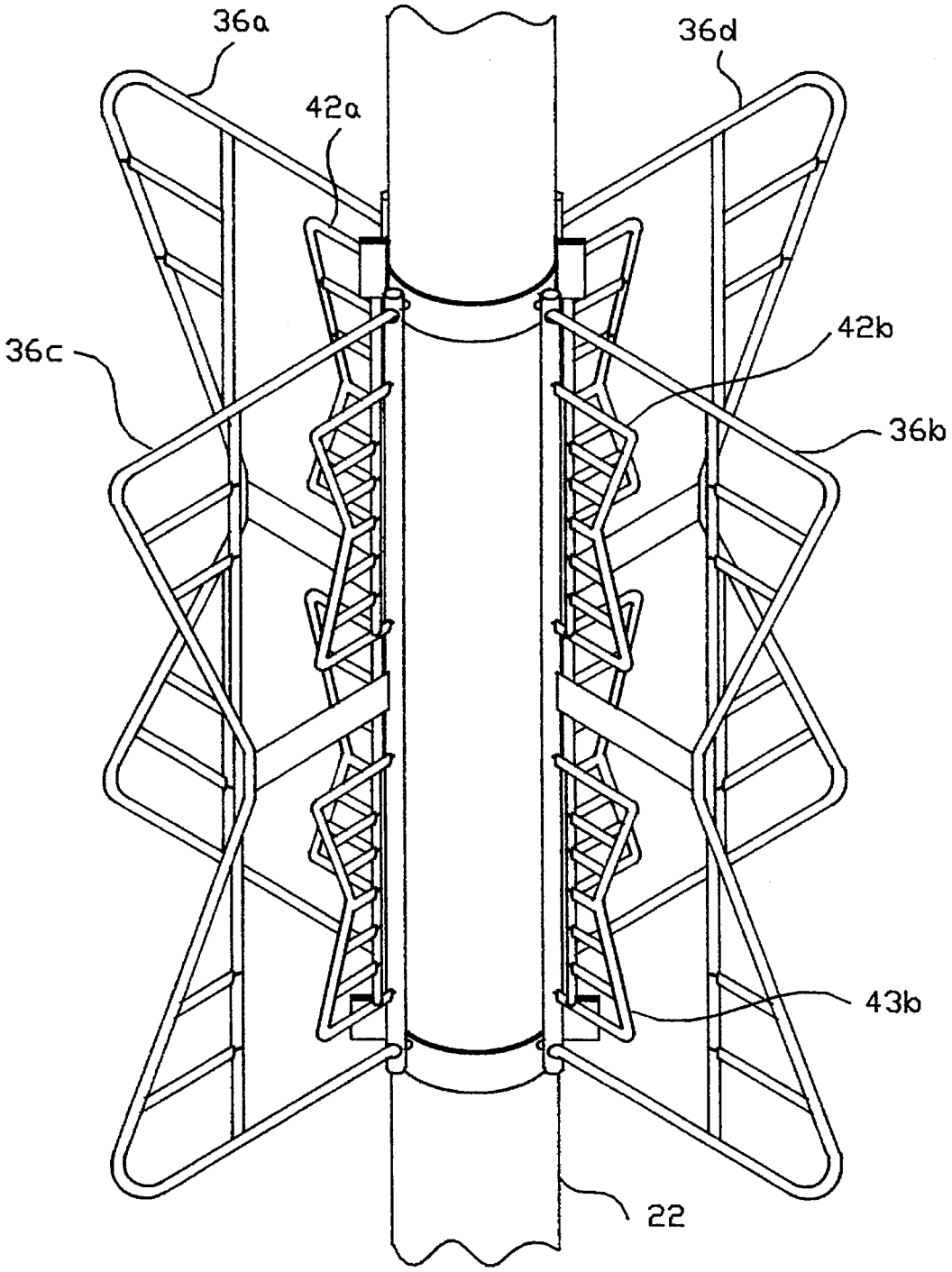
FIG. 5 is a perspective view of the antenna of FIG. 2.

The arrangement shown in FIGS. 2 and 3 is of course very simplified and FIG. 5 shows a commercial antenna. Besides the initial batwing elements 36*a* and 36*b*, another pair of batwings 36*c* and 36*d*, provides for an additional radiation pattern such as 46, 47 shown in FIG. 3, but rotated 90 degrees so that a full circular pattern is provided. At the same time, the additional quadrature batwings will not be either interfered with by the, for example, batwings 42*a* and 42*b* for the same reason that the larger batwings 36*a*, 36*b* do not interfere with quadrature batwings 36*c*, 36*d*.

Figure 6:
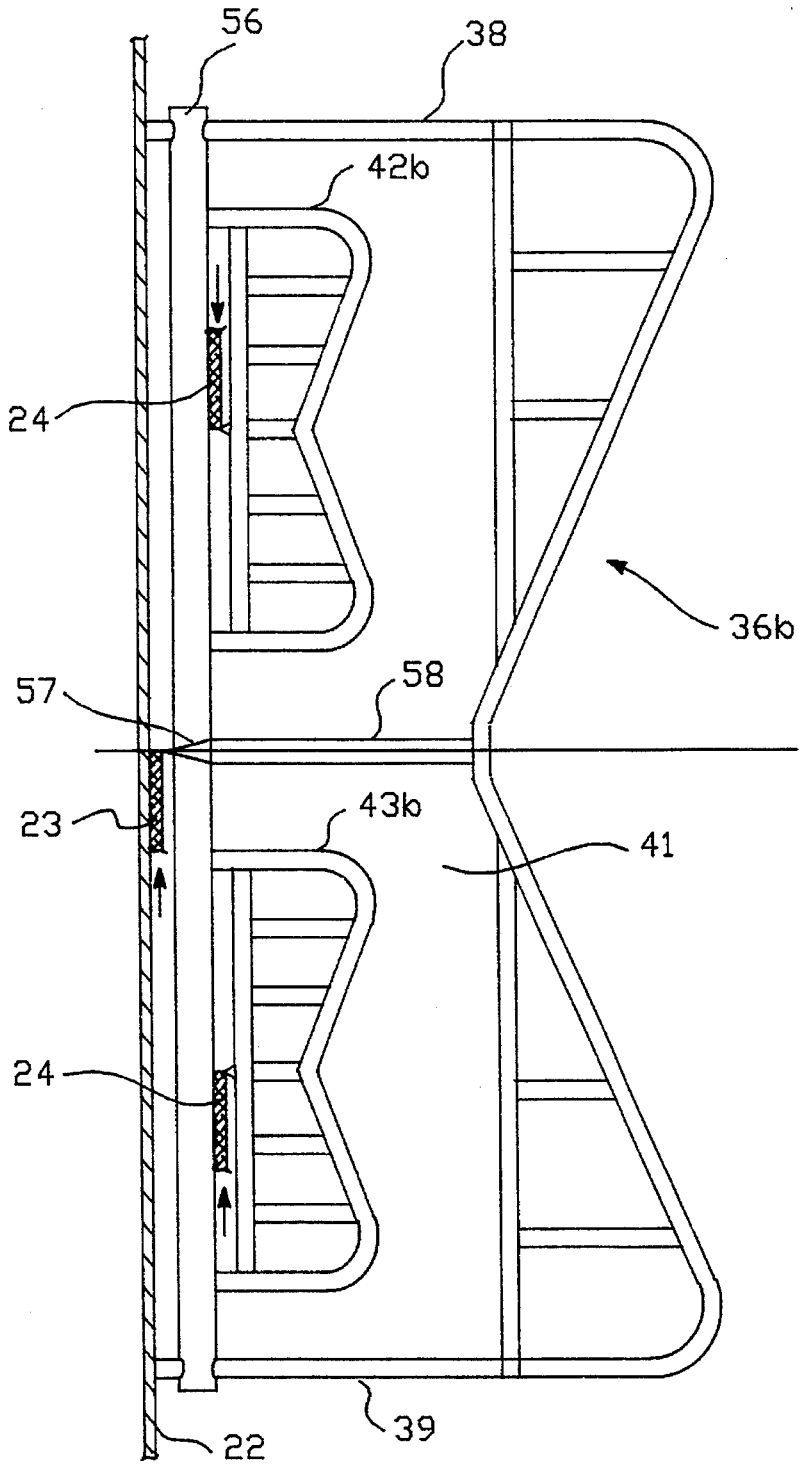
FIG. 6 is an elevational view of one of the antenna portions of FIG. 5.

FIG. 6 shows an even more enlarged view of, for example, batwing 36*b* which is constructed of rods with an upper terminating rod 38 and a lower terminating rod 39 attached to the support tower 22. The substantially vacant rectangular space, of course, is illustrated generally at 41 in which the smaller batwings 42*b*, 43*b* are again fastened to the tower 22 and the intermediate conductive rod 56. Batwing 36*b* is fed through coaxial cable 23 (see FIG. 1) from its center conductor 57 and the intermediate rod 58. Then the smaller batwings 42*b* and 43*b* are fed either collectively or individually in the same manner by the coaxial cable 24.

Figure 7:
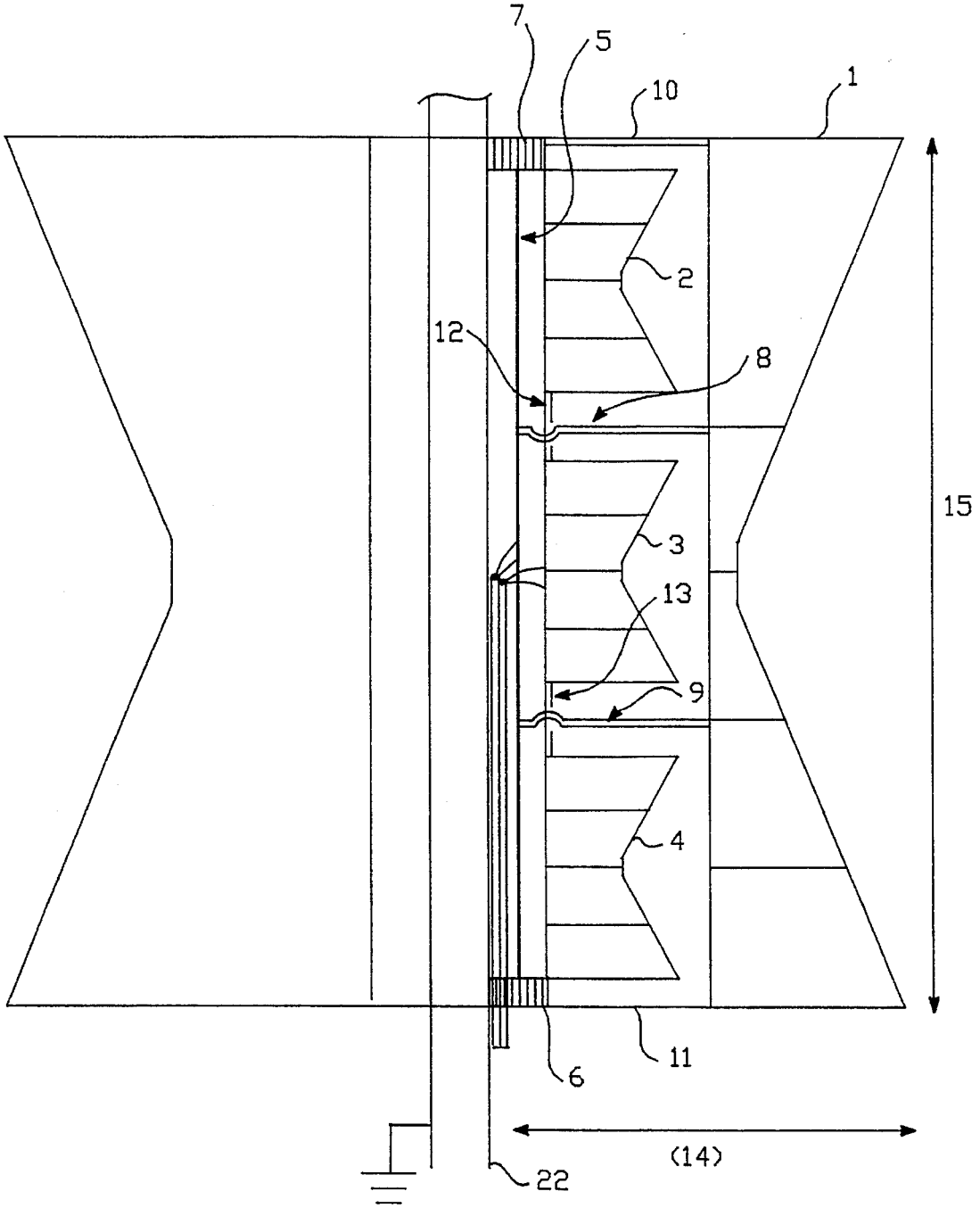
FIG. 7 is a plan elevational view similar to FIG. 6 but of an alternative embodiment.

FIG. 7 illustrates an alternative embodiment of the invention where rather than the batwings being constructed of rods, they may consist of conductive planes indicated in the case of the larger batwing by plane 1 connected to the pole 22 by rods 10 and 11 and the smaller batwing antennas 2, 3 and 4. Conductive plates 6 and 7 connect or attach both the rods 10 and 11 to the ends of the smaller batwings 2 and 4. The rods 7 and 8 offer additional support for the panel 1. The vertical dimension 15 and the horizontal dimension 14 are such that the element 1 will resonate at the lower frequency. The same is true of the higher frequency batwing elements 1, 2, 3 and 4.

Thus an improved dual frequency antenna has been provided where within the same radiating aperture two different frequencies are accommodated. This is done without any major reconstruction of the existing transmitting tower.

What is claimed is:

1. A radio frequency antenna for radiating a pair of radio frequency signals having first and second frequencies with a ratio of substantially two to one or greater comprising:

a first pair of batwing radiating elements for mounting on a vertical support mast and for radiating said first frequency;

each said batwing element having an effective conductive sheet partially formed by a top horizontal termination and a bottom horizontal termination which also circumscribe with said support mast a substantially vacant rectangular space;

two or more smaller batwing radiating elements for radiating a second higher frequency mounted to said mast substantially within said vacant rectangular space of one of said first pair of batwing elements and being substantially co-linear with said effective conductive sheet of said one element.

2. An antenna as in claim 1 where said second frequency is an integral multiple of said first frequency.

3. An antenna as in claim 1 where said conductive sheet is a grid.

4. An antenna as in claim 1 including a second pair of radiating elements resonant at said first frequency and mounted on said mast in quadrature with said first pair resonant at said first frequency to provide a circular radiation pattern.

* * * * *